United States Patent [19]

Clapson

[11] Patent Number: 4,707,955

[45] Date of Patent: Nov. 24, 1987

[54] SCREED RAILS

[75] Inventor: John D. Clapson, Eastleigh, United Kingdom

[73] Assignee: Square Grip Limited, London, United Kingdom

[21] Appl. No.: 750,354

[22] Filed: Jul. 1, 1985

[30] Foreign Application Priority Data

Jul. 4, 1984 [GB] United Kingdom ..... 8416971

[51] Int. Cl.[4] ..... E04B 1/00

[52] U.S. Cl. ..... 52/98; 52/330; 52/367; 52/722

[58] Field of Search ..... 52/364, 365, 366, 367, 52/370, 371, 98, 126.1, 126.2, 126.5, 126.6, 723; 404/43, 118; 14/17

[56] References Cited

U.S. PATENT DOCUMENTS

| | | | |
|---|---|---|---|
| 846,249 | 3/1907 | Seiler | 52/167 |
| 1,554,144 | 9/1925 | Villard | 52/98 |
| 1,699,557 | 1/1929 | Yeager | 52/365 |
| 1,767,575 | 6/1930 | Bujack | 52/365 |
| 2,271,079 | 1/1942 | Kieser | 52/98 |
| 4,507,902 | 4/1985 | Lucas | 52/370 |

FOREIGN PATENT DOCUMENTS

| | | | |
|---|---|---|---|
| 515760 | 4/1921 | France | 52/723 |
| 953614 | 12/1949 | France | 52/367 |
| 417838 | 2/1947 | Italy | 52/723 |
| 480259 | 2/1938 | United Kingdom | 404/43 |
| 538481 | 8/1941 | United Kingdom | 52/723 |
| 549252 | 11/1942 | United Kingdom | 404/43 |

*Primary Examiner*—Henry E. Ruduazo

*Attorney, Agent, or Firm*—Pollock, Vande Sande & Priddy

[57] ABSTRACT

A screed rail for use in the in situ casting of concrete comprising beams forming upper and lower edges of the rail, which are connected by elements extending therebetween. The elements are spaced along the length of the rail to provide for the passage of concrete reinforcement. For this purpose, the spaced elements may form slots, or a breakable web can close the respective spacings, to be broken as required. In an alternative arrangement a screed rail has an overall cross-section with a lower portion defined by parallel sides extending a major distance from the lower edge of the rail. In use, the rail is mounted in shoes to enable the level of the rail to be accurately set.

10 Claims, 11 Drawing Figures

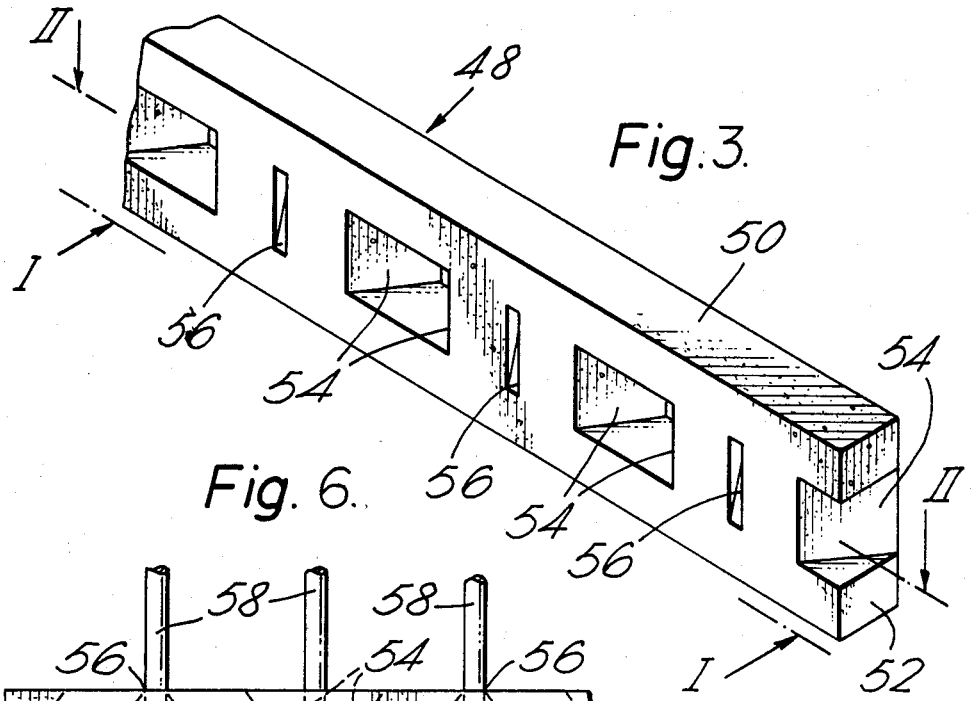
Fig. 3.
Fig. 6.
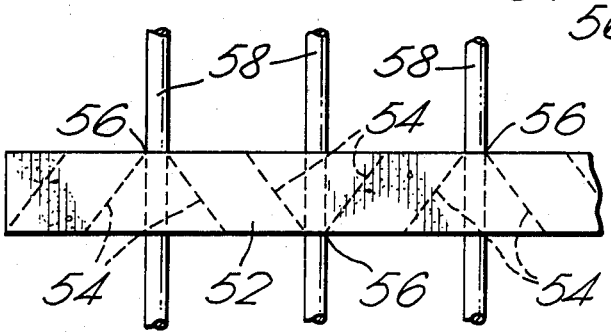
Fig. 4.
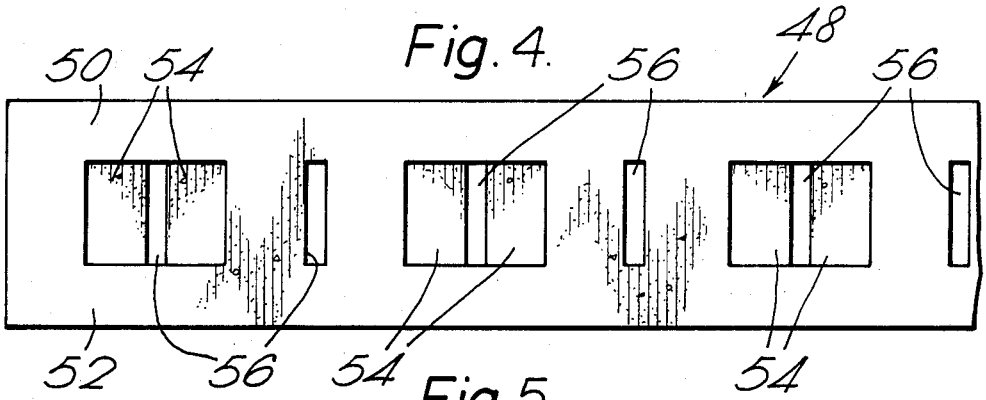
Fig. 5.
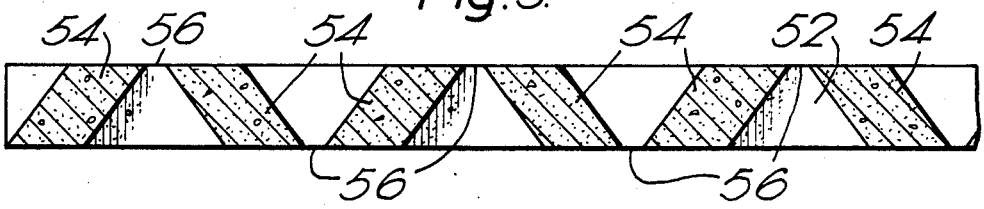

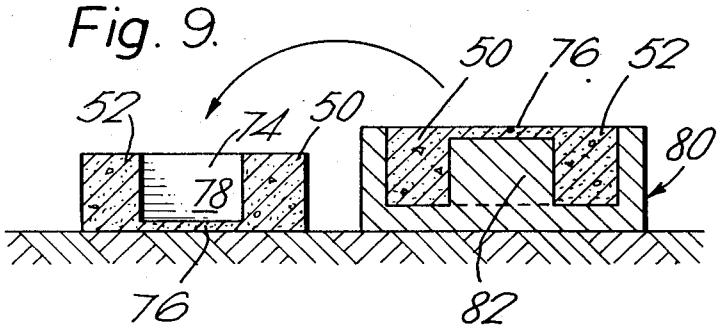
Fig. 9.
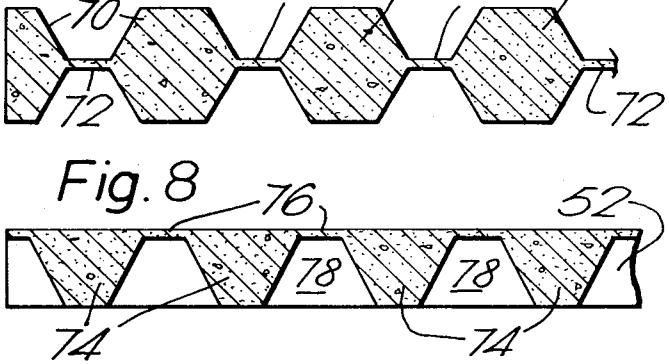
Fig. 7.
Fig. 8
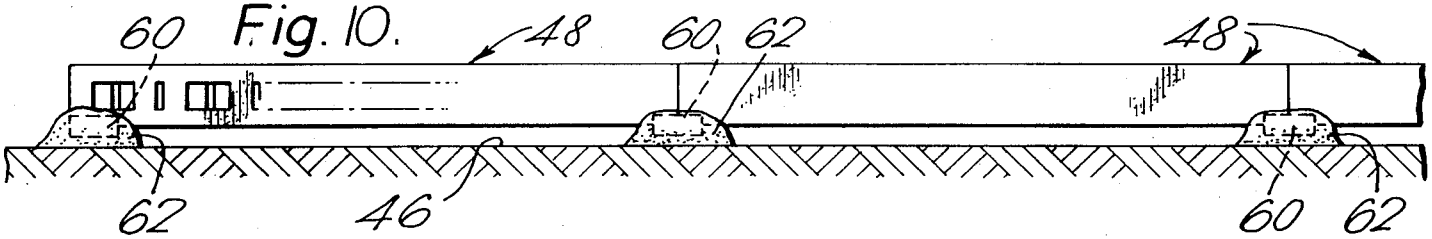
Fig. 10.
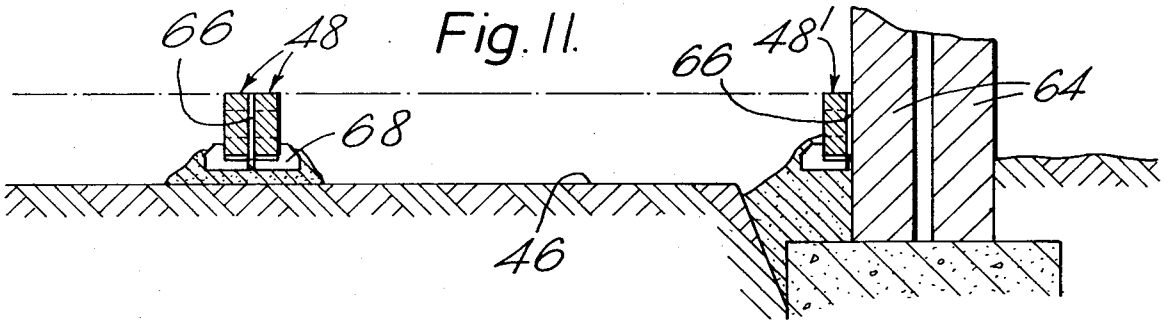
Fig. 11.

SCREED RAILS

BACKGROUND OF THE INVENTION

This invention relates to the casting of concrete, especially the in situ casting of large areas of concrete. Such casting is useful for example in the formation of warehouse floors, car parks and similar open areas, roadways and paths. Particularly it relates to a screed rail which divides such areas into discrete regions, but remains part of the laid area.

Large areas of concrete have traditionally been laid in "patchwork" fashion. Adjacent discrete first regions are cast in a first stage against shuttering which is removed after the regions of concrete have at least partially cured. In a second stage, remaining vacant regions are cast against and between the first regions to complete the total area of concrete to the cast. The first regions define at least part of the boundaries of the regions in the second stage, so that separate shuttering is not needed within the total area and the cast concrete is substantially continuous. This technique is time-consuming as at least two curing stages must be accommodated. Further, the machinery used for tamping or vibrating the cast but not cured concrete in the first stage must be moved between the discrete first regions.

In order to reduce the number of casting stages necessary in the casting of large areas of concrete, methods have been proposed in which the shuttering used becomes a permanent part of the cast layer. Screed rails, usually of pre-cast concrete, are first laid to define a grid of castable regions into which concrete can be poured in a single stage. The screed rails provide support for tamping and vibrating machinery which can thus be applied to the whole area cast, again in a single stage. Two such techniques are disclosed in Swiss Patent Specification No. 545393 and International Patent Publication No. WO 81/02600.

The pre-cast concrete screed rails described in the above Patent publications have in common some primary disadvantages. Being of relatively complex cross-section, they are neither easily cast nor stacked for transportation, and further, they are relatively fragile. As a consequence, particularly because of the stacking problems, they can become cracked or chipped and quite a large proportion of a load of rails must commonly be rejected when the load reaches a site. The stacking problem can also result in the total loss of a load if it is not very carefully assembled and secured on a truck or lorry.

Heretofore, a screed rail of solid, substantially rectangular cross-section has also been either too thin to function with sufficient stability in the casting site, or too large for easy transportation. It is also desirable to define in the screed rail a keying mechanism for the concrete cast against it, and this is achieved in the known rails by forming the screed rail with a recess between enlarged upper and lower edges.

Screed rails of the present invention type are usually of cast concrete which can be reinforced and/or prestressed in conventional manner. Where the concrete area to be laid is to be reinforced, provision can be made for reinforcement to be carried through the rails by the formation of openings therein, for example, normally between the parallel sides thereof. International Patent Publication No. WO 81/02600 referred to above discloses the provision of holes for the passage of connecting devices. However, the provision of holes can complicate the casting of the rail.

OBJECT OF THE INVENTION

The present invention is directed to resolving the above problems in known screed rails. The aim is to provide a screed rail which retains the benefits of the prior rails in use, but is less fragile, and can be easily stacked for safe transportation.

SUMMARY OF THE INVENTION

A screed rail according to the present invention is formed of pre-cast concrete and includes first and second spaced apart beams which define top and bottom portions of the rail. The beams have, respectively, an upper surface and lower surface which have been formed by molding them against opposing sides of an open top mold. A plurality of supporting elements extend between the beams substantially within the width of the rail and define a side portion of the rail. The supporting elements are successively spaced apart along the length of the rail. A plurality of frangable webs extend between the beams and within spaces formed between the supporting elements along the side portion of the rail. The side portion of the rail and outer surfaces of the frangable webs are formed by screeding. The beam, supporting elements and webs form a planar surface on one side of the rail which is coextensive therewith.

A screed rail according to the present invention has a cross-section with parallel sides extending a major distance from one of its longitudinal edges. The extent of the major distance is preferably such that the center of the cross-section is between the parallel sides. In this way, a base layer of rails can be mounted in or between blocks in a stable manner, and second or subsequent layers can be stacked on or between the upper edges of rails in the first.

In the present invention, a keying mechanism may be provided, similar to that known in the art, either by enlarging the upper edge of the rail or by forming recesses in a side of the rail. The latter design enables the rail of relatively large cross-section to be employed without the rail being so bulky as to incur transportation problems, but providing sufficient stability to be simply laid on the subtrate at the casting site.

The former design may include recesses in the parallel sides of the rail, but the relatively thin lower part will not normally provide sufficient stability at the casting site to permit easy laying or resist the lateral pressure of wet concrete cast thereagainst. The rails must be quoined in place in these circumstances.

According to the present invention, a rail may be supported in shoes spaced along the length thereof, the shoes being disposed on the substrate in, for example, concrete dabs. Shoes may be employed if additional stability is required, or if the substrate is uneven as described below. Such shoes may be formed with a simple slot for receiving the rail, and wedges or other devices can be included to lock it in place. This arrangement has a principal advantage in that the substrate can be less even or level than it would need to be to support each rail along substantially its entire length, bearing in mind that its upper edge will define the eventual concrete surface. Spaces may be used to increase the height at which a rail is supported by a shoe for fine adjustment if needed. It should be noted, of course, that leakage of wet concrete through or under a screed rail is usually of relatively small importance when it is being poured on both sides substantially at the same time, although undesirable gaps, particularly larger ones, can be filled as required. The shoes are typically formed in cast concrete, but other materials, such as steel, can be used.

Pouring of concrete to the boundary of an area is also facilitated using screed rails of the invention. "Half" rails can be used, i.e., with recesses only on one side. However, "full" rails can often be sufficient on their own.

According to the present invention, connecting rails can be pre-cast into th rail for subsequent connection to reinforcement or other mechanisms placed in adjacent casting regions. This is particularly useful if, for some reason, openings in the rail are to be avoided.

The nature of the supporting elements may be selected according to the strength required of the beams, but for ease of fabrication, are wall portions with surfaces which extend diagonally from one side of the rail to the other. The slots are thus defined by relatively thin edge portions which can be easily broken, wtihout substantially weakening the structure of the rail, to force connecting devices or reinforcement itself of larger dimension than or imperfectly aligned with the slots, therethrough. Thus, the slots may be relatively narrow or in some instances be totally closed.

Formation of supporting elements some distance apart further reduces rail bulk, thereby facilitating handling and transportation, but also results in the creation of wide slots. In this case, such slots can be closed by webs joining the elements, typically at one side of the rail. Connecting devices or reinforcement can be forced through the webs with relative ease at chosen locations, and the disposition of the devices or reinforcement is therefore less predetermined. Reinforcement of the webs can be used if desired to minimize fraction thereof around connection devices or reinforcement as it is forced through. Webs of up to 10 mm thickness are contemplated, 3 to 6 mms being preferred.

While the provision of webs of the above type is particularly suited to the above embodiments of the invention, it will be understood that they may also be used in the other variants described herein.

Screed rails according to the invention are particularly suited to battery casting. The parallel sides can be cast against formers which are bendable about axes perpendicular to the longitudinal direction of the rail, enabling a plurality of rails to be cast in a block which can be stored and if desired, transported as such, prior to full cure. Cured rails can be removed seriatim from a block as needed.

The provision of recesses in concrete rails of the invention as described above also serves to enhance the keying of poured concrete to the rail, and an irregular surface can be provided on at least the sides of the rail to this end. Such irregularity may take the form of one or more ribs on the surfaces, extending vertically, horizontally or at any chosen angles. Such ribs may be continuous or discontinuous. Other forms of irregularity may be adopted, such as spaced projections or recesses, alternative or additional to the provision of ribs. The nature of the surface irregularity chosen will to some extent at least be determined in relation to the casting method used for the rail, and an intended application.

BRIEF DESCRIPTION OF THE DRAWINGS

The invention will now be described by way of example and with reference to the accompanying drawings wherein:

FIG. 2 is an elevation showing a screed rail of the present invention in place on a substrate;

FIG. 3 is a perspective view showing an end portion of a screed rail according to another embodiment of the invention;

FIGS. 4 and 5 are elevation and sectional plan views taken respectively along lines I—I and II—II of FIG. 3;

FIG. 6 is a plan view of the embodiment of FIG. 4 with connecting devices or reinforcement passing therethrough;

FIGS. 7 and 8 are views similar to that of FIG. 5 showing sectional plan views of fifth and sixth embodiments of the invention;

FIG. 9 is a sectional view taken along line III—III of FIG. 8, illustrating a casting technique for the rail;

FIG. 10 is an elevation similar to that of FIG. 2 showing screed rails according to the fourth embodiment of the invention in place on a substrate; and FIG. 11 is an end view of adjacent screed rails in place.

DESCRIPTION OF THE PREFERRED EMBODIMENTS

Figure 1:
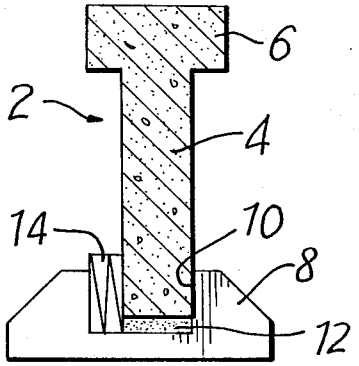
FIG. 1 show in cross-section a screed rail according to one embodiment of the invention.

The screed rail 2 shown in FIG. 1 is of T-shaped cross-section having a web 4 and an enlarged upper edge portion 6. The rail is mounted in a shoe 8 formed with a slot 10 for receiving the lower edge portion of the rail 2. Spacers 12 are shown to locate the rail 2 vertically with respect to the shoe 8, and wedges 14 for locking the rail 2 in the slot 10 from one side.

FIG. 2 shows aligned screed rails 2 laid in shoes 8 mounted in concrete dabs 44 on a substrate 46. The shoes are shown disposed at the ends, forming a coupling between successive rails, although further intermediate shoes and/or dabs may be used as required to prevent sagging or other deformation before or during the pouring of the concrete thereagainst. Levelling of the rails is accomplished primarily by the amount of concrete used in the dabs 44 and if necessary, further vertical adjustment is made using spacers 12 as discussed above. Because the height of the rails is established only at the dabs 44, the substrate 46 therebetween does not require accurate levelling itself. Once in place, the rails may be further secured by the use of additional concrete around the dabs 44 to hold the rails to the shoes 8 and in the slots 10.

FIGS. 3 and 5 illustrate another embodiment of the invention in which the rail 48 comprises upper and lower beams 50 and 52 connected by portions 54. The portions 54 are better shown in FIG. 5 as diagonal walls alternately inclined with respect to the longitudinal axis of the rail to define slots 56 at either side of the rail extending between the beams 50 and 52. The structure shown is strong, stable with or without the use of shoes, spacers and wedges, depending on the intended use and the overall thickness of the rail, and not unduly bulky in view of the large voids formed between the walls 54. As shown in FIG. 6, connecting rods, reinforcing rods or the like can pass through the slots 56, and it will be appreciated that rods of larger dimension than the slots 56 can be forced through by chipping the edge of the slots 56 without substantially affecting the strength of the rail 48 as a whole. It will be appreciated that the slots 56 may therefore be very narrow, or even closed. As described below, the slots may be closed by a thin web of concrete through which connecting devices or reinforcement may be forced, whereby the possibility of leakage of poured concrete through the rail can be substantially eliminated. The overall rectangular cross-section of the rail renders stacking and transportation very easy.

Figure 8:
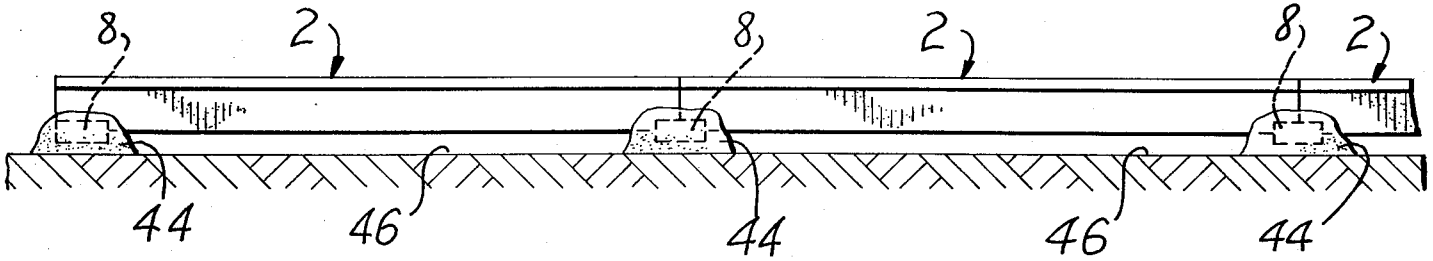

The embodiments of FIGS. 7 and 8 are of broadly similar construction to that of FIG. 3, differing primarily in the nature of the spacing elements. In the embodiment of FIG. 16 elements 70 of hexagonal cross-section are used, with edges of adjacent elements connected by a web 72. Regular hexagonal sections may be used, in which case the webs 72 are in a substantially central plane of the rail. Alternatively, irregular cross-sections may be adopted to locate the webs 72 towards one or the other side of the rail. The webs 72 may also be disposed alternately towards opposite sides of the rail, or oriented obliquely across the rail by suitable selection of the spacing element cross-section.

FIG. 8 shows a rail cross-section in which the section of the spacing elements 74 is an isosceles trapezium. Webs 76 connect the bases of adjacent elements 74 along one side of the rail to form a continuous surface on that side and a series of recesses 78 on the other. This design has particular advantages in the manufacture of the rail as is apparent from FIG. 18 which shows the rail being cast in a tray 80. The tray has spaced projections 82 which form the recesses 78, and the webs 76 define a substantially flat upper surface. Shortly after casting, the mould can be inverted and the tray 80 removed, leaving the rail to cure while freely supported on the web surface, and enabling the tray to be used again with minimum delay.

As shown in FIG. 10 the rail 48 of FIGS. 3 to 6, or as modified by FIGS. 7 to 9, can also be mounted on shoes 60 and concrete dabs 62 similarly to the rail 2 of FIG. 11, although the greater stability of the rail 48 can obviate the need for shoes 60 and/or dabs 62, depending to some extent at least on the level of the substrate 46. FIG. 20 shows laid rails 48 in an end view, rail 48' being laid against a wall 64. An internal expansion joint 66 is shown to accommodate movement of the cast area, either during or after curing of the concrete. Two rails 48 are shown spaced from the wall 64, disposed in an enlarged shoe 68 and also separated by an expansion joint 66 to provide the same flexibility within the cast area.

The rail construction which is the basis of the embodiments of FIGS. 3, 7 and 18 can be modified to have other than parallel sides for specific application. For example vertically inclined walls can provide increased stability with a narrower upper beam while still being easy to stack safely, contiguous rails being inverted. All the rails described herein are suitable for battery casting with suitably shaped formers, and can be reinforced or prestressed by conventional means.

In laying a concrete area using screed rails of the invention, the rails are first located substantially as described with reference to FIGS. 2 and 10 to define discrete regions separated by the rails. It will be understood that the rails will be placed at appropriate angles to each other (normally perpendicular) to separate the regions and define the area to be laid. All the regions can then be filled with concrete in one pouring stage, and then tamped or vibrated using machinery which traverses the fill areas while being supported on the rails. Once tamped, the concrete can be left to cure, and the related equipmemt removed to another site. The rails become part of the concrete structure, being intimately incorporated by means of bonding with the concrete by the respective mechanisms described herein.

Rails according to the invention are usually provided in a variety of lengths; for example, 3, 7 and 12 meters, 4 or 5 meters being a suitable standard length. Their height will normally be 50 to 200 mms, and their maximum width in the range 50 to 100 mms. The dimensions will of course vary, and the intended application may dictate certain criteria with respect to strength and dimensions, the former possibly imposing a need for reinforcement of some kind.

I claim:

1. A screed rail formed of precast concrete comprising:

first and second spaced apart beams defining top and bottom portions of the rail, said first and second beams having, respectively, an upper surface and a lower surface which have been formed by molding them against opposing sides of an open-top mold;

a plurality of supporting elements extending between the beams substantially within the width of the rail, and said supporting elements and beams having side surfaces which define a side portion of the rail, said supporting elements being successively spaced apart along the length of the rail; and, a plurality of frangible webs that are unreinforced and thinner than said supporting elements, said frangible webs extending between the beams and within spaces formed between said supporting elements along said side portion of the rail, said side portion of the rail and outer surfaces of the frangible webs having a substantially coplanar surface permitting forming by screeding.

2. A screed rail formed of precast concrete in a parallel-sided tray-type mold and forming one continuous planar surface of the rail by screeding the concrete in the mold, said rail comprising:

a pair of continuous, spaced apart beams defining top and bottom portions of the rail, each of said beams being of quadrangular, planar-sided cross-section and having one side defined by said one continuous screeded surface and adjacent and opposite sides formed by one side and the bottom of the mold, frangible webs extending along one side between the top and bottom portions; each of said webs being defined by a portion of said one continuous screeded surface, and a plurality of supporting elements, each of said supporting elements extending transversely from said one continuous screeded surface and between said beams to the other side of the rail formed by the bottom of the mold, said supporting elements being equally spaced along the length of said rail and alternating with said webs.

3. A screed rail as claimed in claim 1 or 2 further comprising connecting rods cast into the rail during its formation for coupling the rail to reinforcement on either side of the rail.

4. A screed rail as claimed in claims 1 or 2 wherein said supporting elements have walls extending obliquely between the side portions of the rail.

5. A screed rail as claimed in claim 4, wherein said supporting elements are trapezoidal in cross-section.

6. A screed rail as claimed in claim 1 mounted in spaced shoes having slots for receiving the bottom portion of the rail.

7. A screed rail as claimed in claim 6 further comprising wedges for securing the rail in the slots of the shoes.

8. In combination a screed rail and shoe support, said screed rail formed of precast concrete comprising:

a pair of spaced apart beams defining top and bottom portions of the rail;

a plurality of supporting elements extending between the beams substantially within the width of the rail and defining a side portion of the rail;

said supporting elements being successively spaced apart along the length of the rail;

a plurality of frangible webs extending between the beams and within spaces formed between said supporting elements along said side portion of the rail, whereby the beams, supporting elements and webs form a planar surface on said one side of the rail which is co-extensive therewith and may be formed by striking or screeding said planar surface and a pair of spaced shoes having slots receiving the bottom portion of the rail, said bottom portion being secured in said slots by wedges.

9. A screed rail as claimed in claim 8 further comprising connecting rods cast into the rail during its formation for coupling the rail to reinforcement on either side of the rail.

10. A screed rail as claimed in claim 8 further comprising spacers for setting the height of the rail in the slots of the shoes.

* * * * *